US009883980B2

(12) United States Patent
Lapuente

(10) Patent No.: US 9,883,980 B2
(45) Date of Patent: Feb. 6, 2018

(54) LAMINAR-FLOW OPERATING THEATRE

(75) Inventor: Carlos Ruiz Lapuente, Barcelona (ES)

(73) Assignee: Carlos Ruiz Lapuente, Barcelona (ES)

( * ) Notice: Subject to any disclaimer, the term of this patent is extended or adjusted under 35 U.S.C. 154(b) by 1276 days.

(21) Appl. No.: 13/132,258

(22) PCT Filed: Dec. 2, 2009

(86) PCT No.: PCT/ES2009/070551

§ 371 (c)(1),
(2), (4) Date: Jun. 1, 2011

(87) PCT Pub. No.: WO2010/063867

PCT Pub. Date: Jun. 10, 2010

(65) Prior Publication Data

US 2011/0230130 A1 Sep. 22, 2011

(30) Foreign Application Priority Data

Dec. 3, 2008 (ES) ..... 200803439

(51) Int. Cl.

| | |
|---|---|
| ***A61G 13/10*** | (2006.01) |
| ***F24F 3/16*** | (2006.01) |
| ***F24F 9/00*** | (2006.01) |

(52) U.S. Cl.

CPC ..... *A61G 13/108* (2013.01); *F24F 3/1607* (2013.01); *F24F 9/00* (2013.01)

(58) Field of Classification Search

CPC ..... A61G 13/108; F24F 3/607; F24F 9/00
USPC ..... 454/187, 189; 351/221
See application file for complete search history.

(56) References Cited

U.S. PATENT DOCUMENTS

| | | | | |
|---|---|---|---|---|
| 3,721,067 | A * | 3/1973 | Agnew | A61G 13/108 128/897 |
| 3,774,522 | A | 11/1973 | Marsh | |
| 3,893,457 | A | 7/1975 | van der Waaij | |
| 3,998,142 | A | 12/1976 | Foreman et al. | |
| 4,063,495 | A | 12/1977 | Duvlis | |
| 4,618,222 | A * | 10/1986 | Eisenberg | 359/507 |
| 4,781,108 | A | 11/1988 | Nillson | |

(Continued)

FOREIGN PATENT DOCUMENTS

GB 2202980 A * 10/1988

OTHER PUBLICATIONS

Jurnal: Rheologica Acta 24: 588-595.*
International Search Report dated Feb. 25, 2010 for PCT/ES2009/070551.

*Primary Examiner* — Helena Kosanovic
(74) *Attorney, Agent, or Firm* — Sterne, Kessler, Goldstein & Fox P.L.L.C.

(57) ABSTRACT

Laminar-flow operating theatre that comprises a support (4) that defines a horizontal plane, on which the patient (2) rests, which has a main longitudinal direction, on which support (4) there is, in addition, an operating region (R), laminar-flow-emitting unit (5) and an air-absorption unit (6), wherein the laminar-flow-emitting unit (5) emits the laminar flow in a horizontal direction which is oblique with respect to the longitudinal position of the support (4) such that said direction of incidence of the flow reaches the operating region (R) for the patient (4), and the air-absorption unit (6) is in a horizontal absorption direction which is oblique with respect to said longitudinal direction of the patient's support (4).

14 Claims, 3 Drawing Sheets

(56) References Cited

U.S. PATENT DOCUMENTS

| | | | | |
|---|---|---|---|---|
| 4,955,203 | A * | 9/1990 | Sundhar | 62/3.61 |
| 6,081,336 | A * | 6/2000 | Messner et al. | 356/624 |
| 6,532,108 | B1 * | 3/2003 | Pensel | 359/384 |
| 7,753,977 | B2 * | 7/2010 | Lyons et al. | 55/385.1 |
| 7,901,080 | B2 * | 3/2011 | Hauger et al. | 351/246 |
| 2002/0173265 | A1 * | 11/2002 | Kipka | H05K 9/0041 454/184 |

* cited by examiner

LAMINAR-FLOW OPERATING THEATRE

The present application is a U.S. National Phase Application Under 35 USC § 371 and applicant herewith claims the benefit of priority of PCT/ES2009/070551 filed Dec. 2, 2009 which claims priority to ES P200803439, which are incorporated by reference herein in their entireties.

OBJECT OF THE INVENTION

The present invention relates to a laminar flow operating theatre, in which certain conditions have been established in said flow in order to prevent dust or particles present on the various surfaces near the operation from rising and causing infection.

BACKGROUND OF THE INVENTION

Operating theatre are known that use laminar flow generation devices to prevent infections.

The incidence of a vortex-free laminar flow on a surface with particles prevents these from leaving the surface and migrating to regions where the intervention is being carried out, potentially causing infection.

The present invention establishes additional conditions on the flow treatment that further reduce the risk of infection.

DESCRIPTION OF THE INVENTION

The invention consists in an operating theatre that incorporates said improvements, wherein the problem solved is mainly how to establish the laminar flow so that its movement does not lift particles that have already been deposited on surfaces near the region where the intervention is being performed.

To solve this problem, the invention establishes as essential characteristics that the laminar flow operating theatre comprises:

A support defining a horizontal support plane, on which the patient rests, which has a main longitudinal direction, and on which support there is an operating region;

A laminar flow emitting unit and an air absorption unit; wherein the laminar flow emitting unit emits the laminar flow in a horizontal direction that is oblique with respect to the longitudinal position of the support, such that said direction of incidence of the flow reaches the operation region for the patient, and the air absorption unit is in a horizontal absorption direction which is oblique with respect to said longitudinal direction of the patient support.

The cabins used in the state of the art that make use of flows originating from above carry particles from the working instruments, such as a microscope, in a downward direction and do not provide a laminar flow in the region under said instrument.

Instead, cabins with frontal horizontal flow and upper elimination promote a 180° loop and generate turbulences when reaching the working instruments (such as a microscope).

In both cases the laminar nature of the flow disappears, reducing air purity in the surgical region.

Instead, the conditions claimed give rise to a flow that describes an arc parallel to the surgical region, preventing the problems described above, mainly associated to the presence of instruments near the operating region.

The air projected by the flow emitting unit is evacuated with another unit, the air absorption unit. This latter unit is also inclined and oblique, allowing to form a trajectory in a horizontal arc that is incident on the region to be operated on, achieving the aforementioned objective.

The most suitable angles for placing the units are such that the incident and evacuation current lines are from 40° to 60°.

The specific forms of embodiment of the invention comprised in the dependent claims 2 to 8 are considered to be incorporated in this description by reference.

DESCRIPTION OF THE DRAWINGS

The present specification is completed by a set of drawings that illustrate a preferred embodiment and in no way limit the invention.

DETAILED DESCRIPTION OF THE INVENTION

Figure 1:
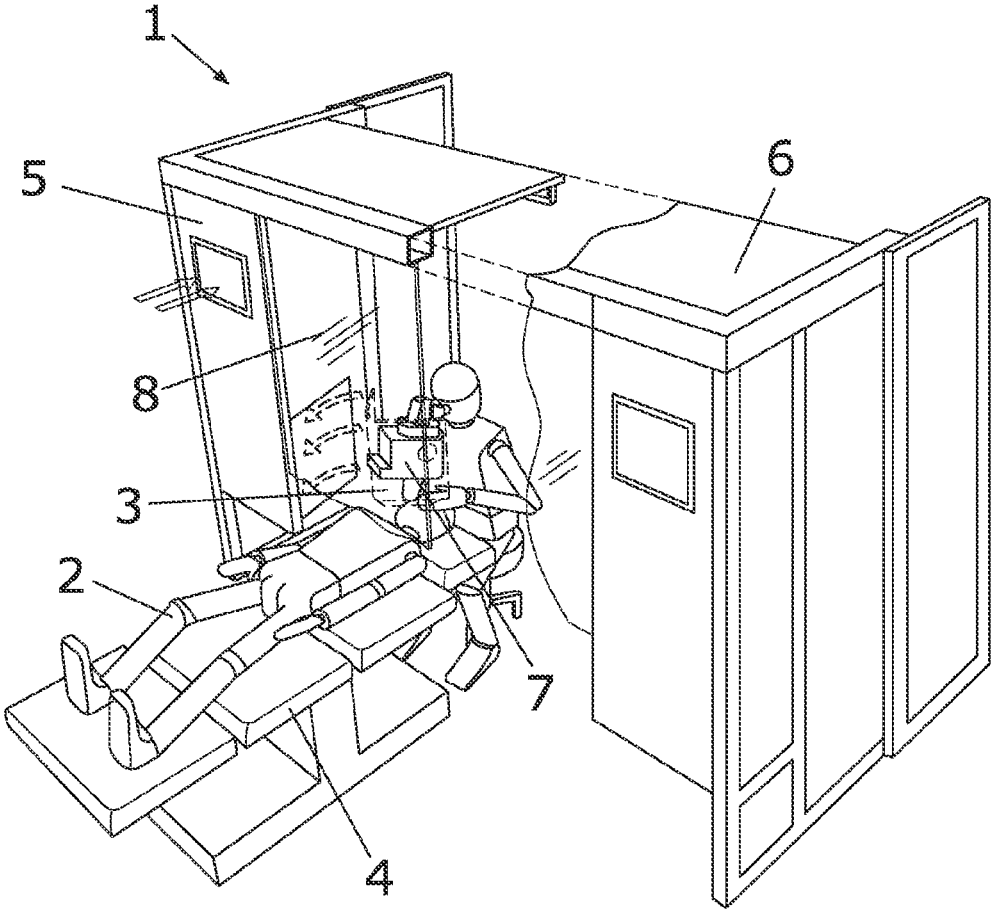
FIG. 1 shows a perspective view of an example of embodiment of the operating theatre of the invention, showing the patient lying on the support table.

FIG. 1 shows an example of embodiment of the invention with an operating theatre (1) comprising, among other elements, a support table (4) on which lies the patient (2) who will be operated on, in this example of embodiment in the eyes, leaving the working region near the eyes in an area in which the laminar air flow is controlled.

As shown in FIG. 1, the head is on the other side of a partition (8) having two units on either side of it: a flow emitting unit (5) and an air absorption unit (6), both having an oblique outlet.

Figure 3:
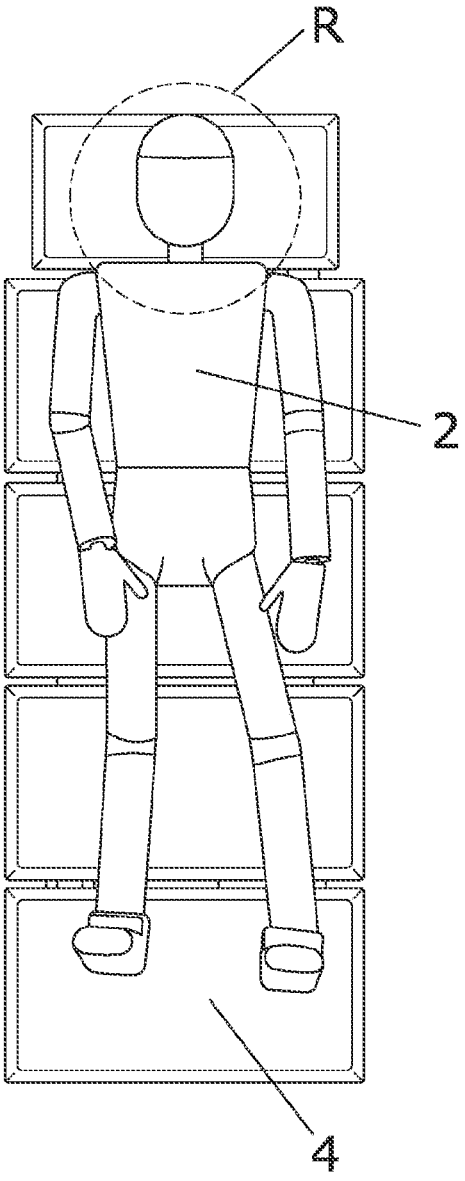
FIG. 3 is a schematic plan view of the support table with the patient lying on it, establishing in this example the working region during the surgical intervention.

Between the two units (5, 6) is the surgeon in charge of the operation, who has a region (R) represented in a plan view in FIG. 3 with a controlled laminar flow.

The flow is controlled and has an angle of incidence such that any particle present on nearby surfaces will not migrate to the intervention region.

Figure 2:
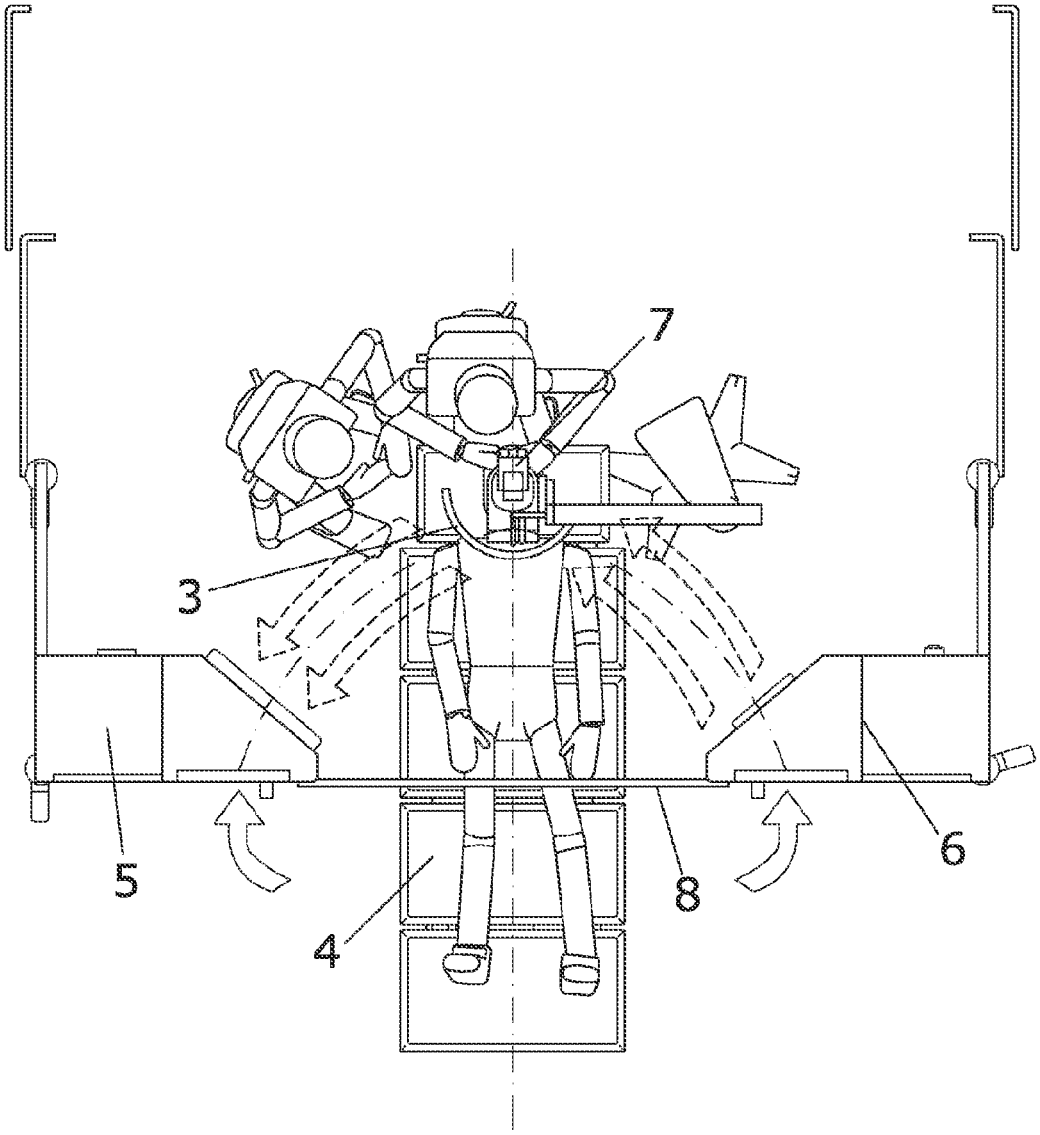
FIG. 2 shows a plan view of the same embodiment, with two persons accessing the operating region and the flow lines that describe an arc.

As shown in FIG. 2, the angles of the incident flow and the flow extracted by absorption give rise to an arc that reaches the operation region (R). This arc passes under the instruments needed for the operation, preventing any particles that may be on said instruments from migrating to the operating region. Similarly, as the laminar flow is disposed horizontally and in an arc, it can reach the surface on which the operation is being performed, as it is not hindered in its trajectory by the presence of instruments. As indicated, the trajectory passes under the instruments.

In the example of invention in which the operation is an eye operation, the surgeon must use a microscope (7) placed on the head of the patient (2), who is facing upwards.

The microscope (7) is protected by a casing (3) that prevents the laminar flow from reaching the microscope (7) and the surgeon herself.

An additional solution is to incorporate a casing (3) with a porous surface structure, such that it is more difficult for the particles that may be on this casing (3) to migrate, even if the laminar flow is incident on it. The laminar flow that may be incident on a casing with these characteristics continues being laminar.

This effect is enhanced when a pressure differential is established between the two sides of the surface of the casing (3), favouring an absorption effect as specified in claim 6.

The incident flow can change in this example of embodiment, exchanging the functions of the air emitting unit (5) and air absorbing unit (6). Depending on which eye is being operated on, this exchange allows producing the laminar flow emission from the side adequate for the intervention, without changing the configuration of the device.

An interesting example of embodiment incorporates a folding casing (3) that allows a compact storage of the equipment after the intervention.

The region (R) in which the flow is controlled by the air emitting unit (5) and air absorption unit (6) requires that the position of the patient (2) and the microscope (7) be correct and that they are inside said region (R).

For this purpose, two light beams, such as lasers, are provided, one for determining the position of the patient (2) and another for determining the position of the microscope (7) with respect to the support table (4). As these positions are independent, it is appropriate that the light beams have different colours to allow a correct positioning of both the patient (2) and the microscope (7) independently of each other.

The invention claimed is:

1. A laminar flow operating theatre comprising:

a support that defines a horizontal plane, the support having a main longitudinal direction;

an operating region;

a laminar flow emitting unit that emits a laminar flow at an emitting angle from 40° to 60° with respect to the main longitudinal direction to form an arc trajectory across the operating region, the arc trajectory being parallel to the horizontal plane and oblique to the main longitudinal direction of the support; and an air absorption unit that receives the laminar flow at an absorption angle from 40° to 60° with respect to the main longitudinal direction such that the arc trajectory extends from the laminar flow emitting unit to the air absorption unit, the air absorption unit being spaced apart from the laminar flow emitting unit by a partition, wherein the laminar flow emitting unit and the air absorption unit are positioned on an interior side of the partition.

2. Operating theatre according to claim 1, wherein the functions of the air emitting unit and air absorption unit are configured to be exchangeable.

3. Operating theatre according to claim 1, further comprising:

a microscope; and a casing, such that the microscope is protected from the laminar flow by the casing.

4. Operating theatre according to claim 3, wherein the casing is made of a porous material.

5. Operating theatre according to claim 3, wherein the casing has means for establishing a pressure at the surface opposite to the surface exposed to the laminar flow, lower than the pressure at said exposed surface.

6. Operating theatre according to claim 3, wherein the casing can be folded.

7. Operating theatre according to claim 1, further comprising:

a device for emitting a beam of light that determines the correct position of a patient in the operating region.

8. Operating theatre according to claim 7, further comprising:

a device for emitting a beam of light that determines the correct position of a microscope.

9. Operating theatre according to claim 8, wherein the device is configured to emit a beam of light having a first color, the first color being representative of a patient; and wherein the device is configured to emit a second beam of light having a second color, the second color being representative of the microscope.

10. Operating theatre according to claim 3, further comprising:

a device for emitting a beam of light that determines the correct position of a microscope In the area in which the laminar flow is predetermined.

11. Operating theatre according to claim 10, further comprising:

a second device for emitting a beam of light that determines the correct position of a patient in the operating region, wherein the light and the second light beam are different colors.

12. Operating theatre according to claim 3, wherein the arc trajectory is under the casing.

13. Operating theatre according to claim 12, wherein the arc trajectory is between the casing and the support.

14. Operating theater according to claim 1, wherein the laminar flow is laminar along the entire arc trajectory.

* * * * *